US005396783A

United States Patent [19]

Park

[11] Patent Number: 5,396,783

[45] Date of Patent: Mar. 14, 1995

[54] COOLING CONSTRUCTION OF AN AIR CONDITIONER OUTER UNIT

[75] Inventor: Sung I. Park, Seoul, Rep. of Korea

[73] Assignee: Goldstar Co., Ltd.

[21] Appl. No.: 159,160

[22] Filed: Nov. 30, 1993

[30] Foreign Application Priority Data

Nov. 30, 1992 [KR] Rep. of Korea ..... 1992-23918

[51] Int. Cl.[6] ..... F25D 23/12

[52] U.S. Cl. ..... 62/428; 62/411; 62/507

[58] Field of Search ..... 62/428, 262, 89, 409, 62/411–412, 507–508

[56] References Cited

U.S. PATENT DOCUMENTS 2,265,054 12/1941 Baker ..... 62/507
2,977,774 4/1961 Ferris ..... 62/507
5,117,656 6/1992 Keck et al. ..... 62/506
5,184,475 2/1993 Matsumi ..... 62/262

*Primary Examiner*—Henry A. Bennet
*Assistant Examiner*—William C. Doerrler
*Attorney, Agent, or Firm*—Morgan & Finnegan

[57] ABSTRACT

This invention relates to a cooling construction of an outer unit in an air conditioner in which an inner unit for supplying a cooled air into a room and the outer unit for cooling down a heat generated from the air cooling, are integrated, comprising a housing having one pair of air discharge openings, each one opening being positioned on one of oppositely positioned sidewalls of the housing, a heat exchanger mounted in front of the housing, and drawing-in/discharging part for drawing-in an outside air into the housing through the heat exchanger and discharging the drawn-in air to outside of the housing through the one pair of the air discharge openings mounted on the housing corresponding to each air discharge openings.

5 Claims, 1 Drawing Sheet

COOLING CONSTRUCTION OF AN AIR CONDITIONER OUTER UNIT

FIELD OF THE INVENTION

This invention relates to air conditioners, more particularly to a cooling construction of an outer unit of air conditioners having integrated an inner unit and outer unit.

BACKGROUND OF THE INVENTION

FIG. 1 shows a cooling construction of an outer unit of a conventional air conditioner including a housing la having opposite air draw-in openings *7a* and *7b*, a heat exchanger 1 positioned in front of the housing 1*a*, an axial flow fan 2 positioned in rear of the heat exchanger 1 for producing an air flow from the air draw-in openings to the heat exchanger 1, a motor 5 driving the axial flow fan 2, and a shroud 3 guiding the air flow to the axial flow fan 2.

A compressor 4 for compressing refrigerant is positioned in the vicinity of one of the air draw-in openings *7b* and a sirocco fan 6 driven by the motor 5 together with the axial flow fan 2 for discharging cooled air into a room, is positioned in the inner unit (not shown) of the air conditioner.

The cooling process of a conventional air conditioner described above in explained hereinafter.

Upon rotation of the axial flow fan 2 and the sirocco fan 6 by the motor 5, the cooled air cooled through the usual operation of the air conditioner is blown into a room by the sirocco fan 6 in the inner unit while outside air flows into the housing 1*a* through the oppositely positioned air draw-in openings *7a* and *7b* on both sides of the housing 1*a* due to the pressure difference across the axial flow fan 2 in the outer unit.

The compressor positioned in the vicinity of the air draw-in evening *7b*, causes a drop of flow speed resulting in non-uniform flow speed as shown in FIG. 1 F and an increase of noise through the compressor is cooled by the air flow.

The drawn-in air, then, passes through the axial flow fan 2 guided by the shroud 3 and cools the heat exchanger 1 positioned in front of the axial flow fan 2 while passing therethrough.

It has been a problem in the cooling construction of conventional air conditioners outer unit that cooling by the heat exchanger part corresponding to the hub *2a* of the axial flow fan where the air does not flow, is not effective.

It has been other problem in the cooling construction of conventional air conditioner outer unit that the direction of air blown by the axial flow fan and the orientation of the fins of the heat exchanger 1 do not match because the way delivering the air to the heat exchanger is blowing type, i.e. blowing directly to the heat exchanger, thereby resulting in the drop of flowing speed of the air and the development of noise.

As seen above, the cooling construction of conventional air conditioner outer units have the problems of the air flow speed drop due to the position of the compressor, existence of dead zone due to the hub of the axial flow fan and the air flow speed drop and the development of noise due to the mis-match of the direction of air flow and the orientation of the fins.

SUMMARY OF THE INVENTION

The object of this invention is to provide a cooling construction of an outer unit of an integrated type air conditioner having an improved cooling capability by providing an uniform air flow flowing through a heat exchanger.

This and other objects and the features of this invention can be achieved by providing a cooling construction of an outer unit in an air conditioner in which an inner unit for supplying a cooled air into a room and the outer unit for cooling down a heat generated from the air cooling, are integrated, comprising a housing having one pair of air discharge openings, each one opening being positioned on one of oppositely positioned sidewalls of the housing, a heat exchanger mounted in front of the housing, and drawing-in/discharging part for drawing-in an outside air into the housing through the heat exchanger and discharging the drawn-in air to outside of the housing through the one pair of the air discharge openings mounted on the housing corresponding to each air discharge openings.

DETAILED DESCRIPTION OF THE INVENTION

Figure 1:
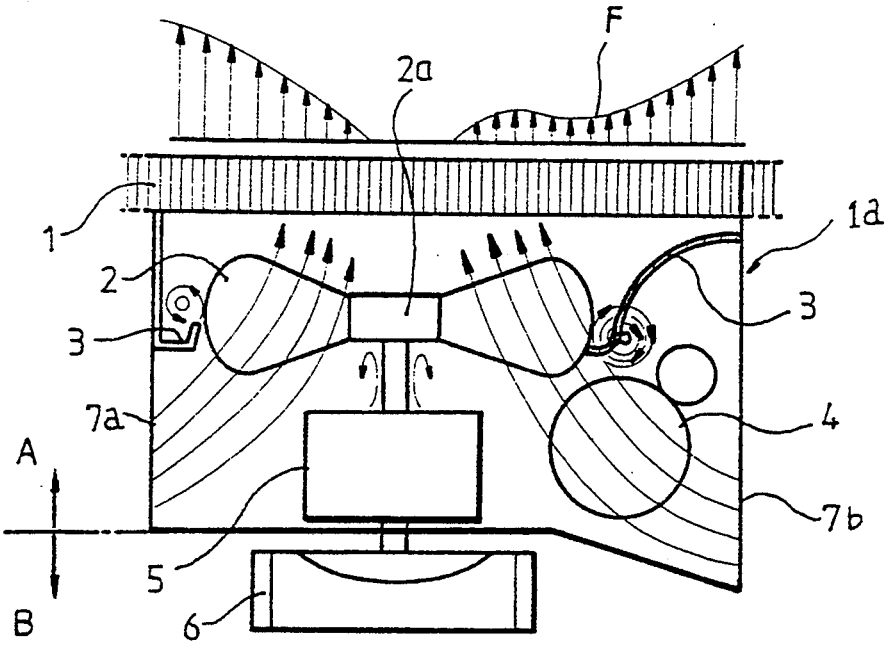
FIG. 1 shows a cooling construction of a conventional air conditioner outer unit, flow paths of the air and the flow speed of the air.
Figure 2:
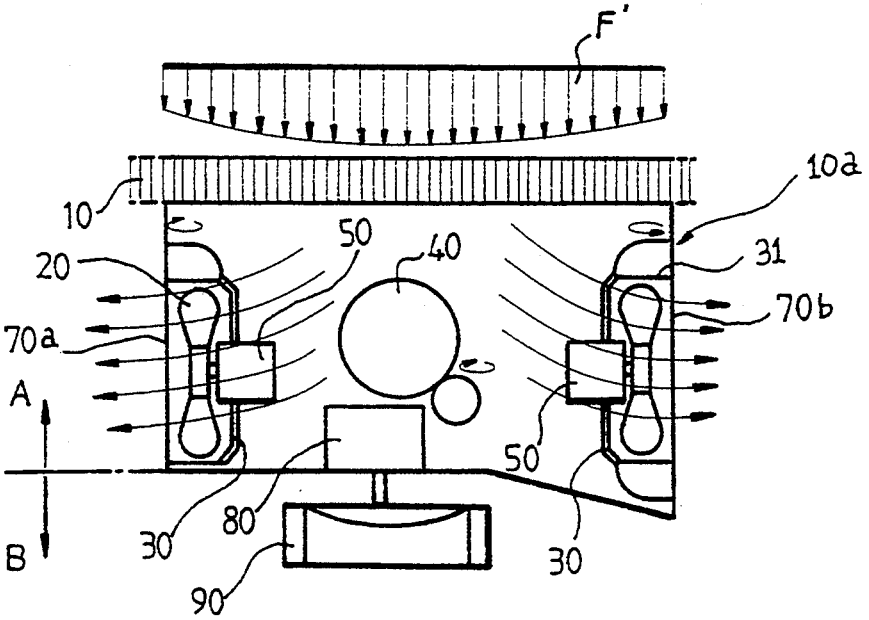
FIG. 2 shows a cooling construction of an air conditioner outer unit, flow paths of the air and the flow speed of the air in accordance with this invention.

As can be seen from FIG. 2, the cooling construction of an air conditioner outer unit in accordance with this invention includes a housing 10*a* having one pair of air discharge openings 70*a* and 70*b*, one each on one sidewall of oppositely positioned sidewalls of the housing, a heat exchanger 10 positioned in front of the housing, and an air drawing-in/discharging means mounted in the housing corresponding to each air discharge openings for drawing-in outside air into the housing through the heat exchanger and for discharging to outside through the one pair of the air discharge openings.

The air drawing-in/discharging means has one pair of fan assembly corresponding to the one pair of air discharge openings for producing the air flow flowing from inside of the housing to outside.

Each fan assembly has a motor 50 generating rotating force, a fan 20 for producing air flow according to the rotating force, a motor frame 30 for mounting the motor on the housing, and a shroud 31 formed on the motor frame for guiding the air flow to the fan.

An axial fan is suitable for this purpose.

In the meantime, the most suitable position of the compressor 40 compressing refrigerant is the middle of the two fans where the air flow is interfered at the least, and a separate motor 80 for driving the sirocco fan is provided, different with conventional way.

The operation of the cooling construction of an air conditioner outer unit described above is explained hereinafter.

When the axial fans 20 are rotated by the motors 50, the air in the housing is discharged to outside of the housing through the air discharge openings. In this time, the air outside of the housing flows into the housing through the heat exchanger 10 due to the pressure difference produced across the axial fans, resulting to cool the heat exchanger.

Further, the compressor 40 is also cooled by the drawing-in air, but does not reduce the air flow speed much because the compressor is positioned in the middle of the two fans.

As can be seen from F' in FIG. 2, the air flow speed at the heat exchanger shows a comparatively uniform distribution having the peak at the center and moderately slow down as it goes to the periphery, because the dead zone by the hub of the axial flow fan is removed, and the compressor and the shroud are positioned not to interfere the air flow.

Further, it is advantageous for reducing the operation noise of an air conditioner according to this invention that having the axial flow fans 20 and the sirocco fan 90 individual motors permitting the fans driving in different speeds or driving the fans selectively choosing only one fan as the necessity arises.

As described above, the cooling construction of this invention can solve the problem of the non-uniform flow speed due to the excessive flow resistance between the air flow produced when the air inside of the housings discharged to outside of housing through the heat exchanger, and the fins, by providing a suction type air flow drawing-in outside air into the housing through the heat exchanger.

Although the invention has been described in conjunction with specific embodiment, it is evident that many alternatives and variations will be apparent to those skilled in the art in light of the foregoing description. Accordingly, the invention is intended to embrace all of the alternatives and variations that fall within the spirit and scope of the appended claims.

What is claimed

1. A cooling construction of an outer unit in an air conditioner in which an inner unit for supplying cooled air into a room and the outer unit for cooling down heat generated from the cooled air are combined, comprising:

a housing having first and second air discharge openings positioned on respective first and second oppositely positioned sidewalls of the housing;

a heat exchanger mounted in front of said housing; and first and second fan assemblies disposed in said housing and drawing-in outside air into said housing through said heat exchanger and discharging the drawn-in air from said housing through the first and second air discharge openings respectively, wherein said first and second fan assemblies include first and second fans positioned directly opposite one another for discharging the draw-in air in opposite directions.

2. A cooling construction as claimed in claim 1, wherein each of said first and second fan assemblies include a motor for generating a rotational force, the first and second fans for generating an air flow in accordance with the rotational force toward outside of said housing, a motor frame for mounting said motor on said housing and a shroud formed on said motor frame for guiding the air flow to said first and second fans.

3. A cooling construction as claimed in claim 2, wherein said first and second fans are axial flow fans.

4. A cooling construction as claimed in claim 2, further including a compressor positioned in the middle of said first and second fan assemblies.

5. A cooling construction as claimed in claim 2, wherein said first and second fans are positioned perpendicular to said heat exchanger.

* * * * *